US011485528B2

(12) United States Patent
Dohrmann et al.

(10) Patent No.: US 11,485,528 B2
(45) Date of Patent: Nov. 1, 2022

(54) DEVICE FOR FITTING CABLE TIES

(71) Applicant: HELLERMANNTYTON GmbH, Tornesch (DE)

(72) Inventors: Oliver Dohrmann, Uetersen (DE); Gisbert Gottlieb, Rosenheim (DE)

(73) Assignee: HELLERMANNTYTON GMBH, Tornesch (DE)

( * ) Notice: Subject to any disclaimer, the term of this patent is extended or adjusted under 35 U.S.C. 154(b) by 191 days.

(21) Appl. No.: 16/163,677

(22) Filed: Oct. 18, 2018

(65) Prior Publication Data

US 2019/0144149 A1 May 16, 2019

(30) Foreign Application Priority Data

Nov. 14, 2017 (FR) ..... 1760689

(51) Int. Cl.

| | |
|---|---|
| ***B65B 13/02*** | (2006.01) |
| ***B65B 13/22*** | (2006.01) |
| ***B26D 1/06*** | (2006.01) |
| ***B65B 59/00*** | (2006.01) |
| ***B26D 5/10*** | (2006.01) |
| ***B65B 57/00*** | (2006.01) |

(52) U.S. Cl.

CPC ..... *B65B 13/027* (2013.01); *B26D 1/065* (2013.01); *B65B 13/22* (2013.01); *B65B 59/00* (2013.01); *B26D 5/10* (2013.01); *B65B 57/00* (2013.01)

(58) Field of Classification Search

CPC ..... B26D 1/065; B26D 1/48; B65B 13/00; B65B 13/04; B65B 13/08; B65B 13/10; B65B 13/16; B65B 13/185; B65B 2210/12; B65B 13/027; B65B 13/14; B65B 13/187; B65B 13/22; B65B 13/345; B25J 15/0226; B26B 15/00; A61B 17/8861

USPC ..... 72/409.09, 409.1; 140/57, 123.5, 123.6

See application file for complete search history.

(56) References Cited

U.S. PATENT DOCUMENTS

| | | | | |
|---|---|---|---|---|
| 4,371,010 | A | 2/1983 | Hidassy | |
| 4,495,972 | A | 1/1985 | Walker | |
| 4,534,817 | A * | 8/1985 | O'Sullivan | B29C 65/08 100/26 |
| 4,790,225 | A | 12/1988 | Moody et al. | |

(Continued)

FOREIGN PATENT DOCUMENTS

| | | |
|---|---|---|
| CN | 1100054 | 3/1995 |
| CN | 1572657 | 2/2005 |

(Continued)

OTHER PUBLICATIONS

"Extended European Search Report", EP Application No. 18192166.9, dated Jan. 15, 2019, 5 pages.

(Continued)

*Primary Examiner* — Adam J Eiseman
*Assistant Examiner* — Stephen Floyd London
(74) *Attorney, Agent, or Firm* — Colby Nipper PLLC

(57) ABSTRACT

A manual automatic device configured for fitting cable ties around a bundle of cables or the like. The device includes a control interface allowing the user of the device to choose an operating mode that tightens but does not cut the cable tie and in which the electric motor which drives the cable tie in tension is controlled in reverse rotation to eject the cable tie before cutting. A method for controlling the device is also presented herein.

16 Claims, 2 Drawing Sheets

(56) References Cited

U.S. PATENT DOCUMENTS

| | | | | |
|---|---|---|---|---|
| 5,205,328 | A | 4/1993 | Johnson | |
| 5,287,802 | A * | 2/1994 | Pearson | B65B 13/18 100/4 |
| 5,595,220 | A * | 1/1997 | Leban | B65B 13/027 140/123.6 |
| 5,809,873 | A * | 9/1998 | Chak | B65B 13/22 100/26 |
| 5,915,425 | A | 6/1999 | Nilsson et al. | |
| 6,206,053 | B1 | 3/2001 | Hillegonds | |
| 6,302,157 | B1 * | 10/2001 | Deschenes | B65D 63/1063 140/123.6 |
| 6,354,336 | B1 | 3/2002 | Leban | |
| 6,401,766 | B1 | 6/2002 | Ishikawa | |
| 6,497,258 | B1 | 12/2002 | Flannery et al. | |
| 6,543,341 | B2 * | 4/2003 | Lopez | B65B 13/06 100/29 |
| 7,124,787 | B2 | 10/2006 | Lueschen | |
| 7,165,379 | B1 * | 1/2007 | Lai | B65B 13/22 100/26 |
| 7,210,506 | B2 | 5/2007 | Magno | |
| 9,481,102 | B1 | 11/2016 | Hojnacki et al. | |
| 2002/0093211 | A1 * | 7/2002 | Filipiak | B25J 15/0226 294/203 |
| 2002/0129866 | A1 | 9/2002 | Czebatul et al. | |
| 2004/0244606 | A1 * | 12/2004 | Haberstroh | B65B 13/18 100/26 |
| 2004/0244866 | A1 * | 12/2004 | Ishikawa | B65B 13/28 140/57 |
| 2005/0178460 | A1 | 8/2005 | Magno | |
| 2005/0178461 | A1 | 8/2005 | Magno et al. | |
| 2006/0011254 | A1 | 1/2006 | Yokochi et al. | |
| 2007/0157555 | A1 | 7/2007 | Tanner | |
| 2007/0199610 | A1 | 8/2007 | Itagaki | |
| 2016/0016682 | A1 * | 1/2016 | Boss | B65B 13/22 100/4 |
| 2016/0046398 | A1 | 2/2016 | Neeser et al. | |
| 2016/0075456 | A1 | 3/2016 | Nomura et al. | |
| 2016/0280405 | A1 | 9/2016 | Thieme et al. | |
| 2017/0174374 | A1 | 6/2017 | Figiel et al. | |
| 2019/0106231 | A1 | 4/2019 | Schwinn et al. | |
| 2021/0094713 | A1 | 4/2021 | Hempe et al. | |

FOREIGN PATENT DOCUMENTS

| | | | |
|---|---|---|---|
| CN | 101585419 | | 11/2009 |
| CN | 102859821 | | 1/2013 |
| CN | 202670128 | | 1/2013 |
| CN | 206579887 | | 10/2017 |
| DE | 69728071 | | 2/2005 |
| DE | 102014103334 | | 9/2015 |
| EP | 0722885 | | 7/1996 |
| JP | H09240617 | | 9/1997 |
| JP | 2000103407 | | 4/2000 |
| JP | 2000103407 | A * | 4/2000 |
| WO | 2009152707 | | 12/2009 |
| WO | 2015067444 | A1 | 5/2015 |

OTHER PUBLICATIONS

"Foreign Office Action", CN Application No. 201811167015.1, dated Apr. 24, 2020, 18 pages.
"Foreign Office Action", CN Application No. 201811344796.7, dated Jun. 28, 2020, 17 pages.
"Non-Final Office Action", Application No., dated May 27, 2020, 13 pages.
"Extended European Search Report", EP Application No. 20198300.4, dated May 20, 2021, 11 pages.
"Foreign Office Action", CN Application No. 201811167015.1, dated Jun. 2, 2021, 7 pages.
"Foreign Office Action", CN Application No. 201811344796.7, dated Jan. 26, 2021, 7 pages.
"Foreign Office Action", CN Application No. 201811167015.1, dated Dec. 11, 2020, 14 pages.
Pishehvari, et al., "Ego-pose estimation via Radar and Openstreetmap-based Scan matching", May 2018, 8 pages.
"Autotool 2000 CPK Operating Instructions", Hellerman Tyton, 106-29006, Apr. 2, 2015, 29 pages.
"Final Office Action", U.S. Appl. No. 16/120,926, filed Nov. 15, 2021, 18 pages.
"Non-Final Office Action", U.S. Appl. No. 17/009,628, filed Nov. 29, 2021, 20 pages.
"Today's Mechanisms Mini Test", 4CR—Technological Studies—Retrieved at: gwcts3.blogspot.com/2011/09/todays-mechanisms-mini-test.html—on Nov. 19, 2021, 3 pages.
"Final Office Action", U.S. Appl. No. 16/120,926, filed Feb. 17, 2022, 13 pages.
"Non-Final Office Action", U.S. Appl. No. 17/009,628, filed Mar. 11, 2022, 23 pages.
"Foreign Office Action", CN Application No. 202011032227.6, dated Jun. 7, 2022, 58 pages.
"Notice of Allowance", U.S. Appl. No. 17/009,628, dated Jul. 29, 2022, 8 pages.

* cited by examiner

DEVICE FOR FITTING CABLE TIES

CROSS-REFERENCE TO RELATED APPLICATION

This application claims the benefit under 35 U.S.C. § 119(a) of Patent Application No. 1760689 filed in the Institut National de la Propriété Industrielle (French Patent Office) on Nov. 14, 2017, the entire disclosure of which is hereby incorporated by reference.

TECHNICAL FIELD OF THE INVENTION

The present invention relates to a manual automatic device for fitting cable ties and a method for controlling such a device.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
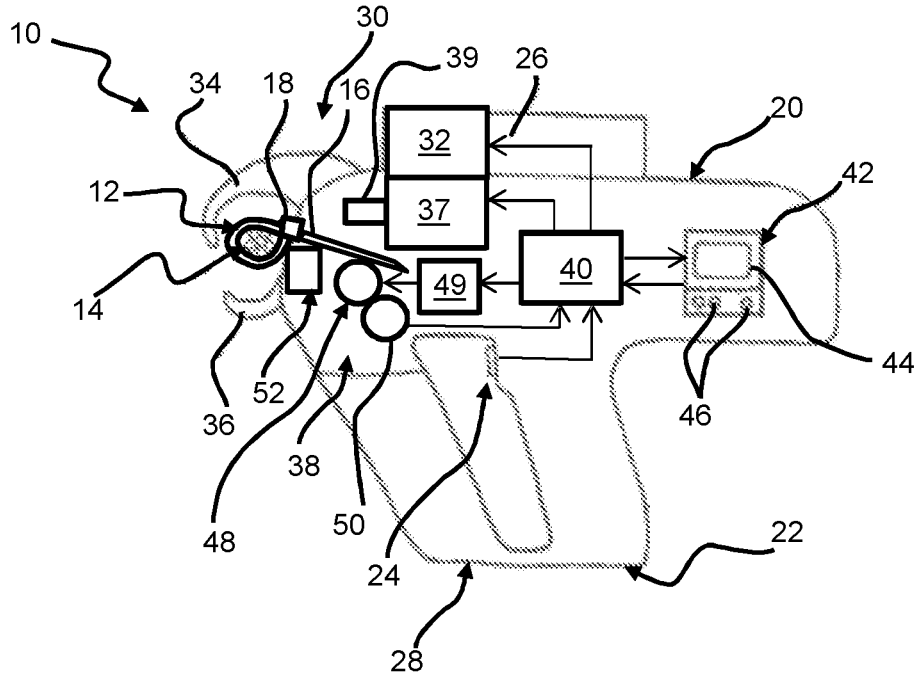
FIG. 1 is a side view which schematically represents a manual automatic device for fitting cable ties according to the teachings of the invention.

FIG. 1 illustrates a manual automatic device, hereinafter referred to as the device 10, for fitting cable ties 12 around a bundle of cables 14. Obviously, it can be used to attach cable ties 12 around other types of bundles or around other objects such as one or more pipes, or strands having dimensions compatible with the span of the device 10.

The cable ties 12 are typically formed by a strap 16, or ribbon, made of flexible plastic material provided at a free end with a non-return ratchet cage 18. The strap 16 is provided on at least one face with sawtooth reliefs designed to cooperate with the ratchet of the ratchet cage 18.

According to the illustrated embodiment, the device 10 comprises a housing 20 provided with a handle 22 in the form of a pistol grip with a switch or trigger 24 making it possible to trigger a tie-fitting operation. The housing 20 preferably comprises a removable magazine 26 designed to contain a reserve of cable ties 12 prior to the fitting thereof and a receptacle 28 designed to receive the cut ends of the cable ties 12 after they have been fitted on a bundle of cables 14.

To allow the fitting of the cable ties 12, the device 10 is provided with an integrated fitting mechanism 30, or positioning device. In the example schematically represented, the integrated fitting mechanism 30 comprises a feed device 32 designed to drive the cable ties 12 from the removable magazine 26 to a pivoting upper jaw 34 and a pivoting lower jaw 36 that are used to form a loop of the cable tie 12 around the bundle of cables 14.

Figure 2:
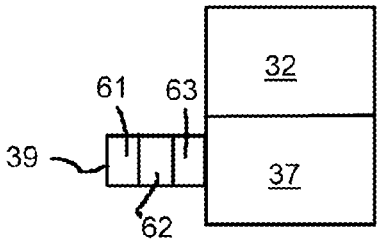
FIG. 2 is a partial view of the side view of FIG. 1.

The integrated fitting mechanism 30 comprises a first electric motor 37 provided with a first driveshaft 39 which is preferably provided with three cams, a first cam 61 controlling the upper jaw 34, a second cam 62 controlling the lower jaw 36, and a third cam 63 controlling a cutting device 52, as further illustrated in FIG. 2. This first driveshaft 39 is designed to make exactly one complete revolution during a complete operating cycle of the device.

An operating cycle of the device here denotes a complete cycle of fitting of a cable tie 12 on a bundle of cables 14, the device 10 being once again ready to fit a cable tie 12 at the end of the cycle.

The device 10 also comprises a tensioning device 38 which drives the free end of the cable tie 12 at the output of the ratchet cage 18 in the direction of tightening around the bundle of cables 14.

The device 10 comprises an electronic unit 40 which controls the integrated fitting mechanism 30 appropriately as a function of the signal given by the trigger 24 and as a function of the settings input by an operator through a control interface 42. The control interface 42 comprises, for example, a display screen 44 and control buttons 46.

The device 10 also comprises an electrical power supply system (not represented).

The tensioning device 38 is here equipped with a toothed wheel 48 which is designed to mesh with the toothed part of the cable tie 12 so as to drive it in the direction of tightening. The tensioning device 38 comprises a second electric motor 49 which drives the toothed wheel 48 in rotation.

Advantageously, the toothed wheel 48 is equipped with a rotary encoder 50 which makes it possible to indirectly count the number of teeth which have meshed with the toothed wheel 48. It is thus possible to very accurately determine the circumference remaining around the bundle of cables 14 by determining the number of teeth of the free part of the cable tie 12 extracted at the output of the ratchet cage 18.

The rotary encoder 50 is connected to the electronic unit 40 which allows the electronic unit 40 to accurately control the second electric motor 49 and the rotation of the toothed wheel 48 as a function of the signal from the rotary encoder 50.

Advantageously, the device 10 comprises a cutting device 52 which makes it possible to cut the strap of the cable tie 12 just at the output of the ratchet cage 18, after the loop of appropriate circumference has been formed around the bundle of cables 14. The cutting device 52 therefore makes it possible to remove the unused part of the cable tie 12.

The control interface 42 allows the user of the device 10 to choose an operating mode of the device 10. A so-called standard operating mode comprises a cycle during which the cable tie 12 is first of all tightened around the bundle of cables 14 then, at the end of the cycle, the cable tie 12 is cut so as to eliminate the free end section of the cable tie 12.

Advantageously, the control interface 42 is configured to control the device 10 in at least one other operating mode, called operating mode without cutting, in which the step of cutting of the cable tie 12 at the end of the cycle is eliminated. For that, the electronic unit 40 is configured to, in the operating mode without cutting, reverse the direction of rotation of the second electric motor 49 at the end of the cycle so as to eject the cable tie 12 from the device 10 before the cutting has taken place.

A method for controlling the manual automatic device 10 in the standard operating mode comprises the following steps:

a) controlling the first electric motor driving the integrated fitting mechanism 30 so as to position the cable tie 12 in a closed loop around the bundle of cables 14, b) controlling the second electric motor driving the tensioning device 38 so as to tighten the cable tie 12 around the bundle of cables 14, and c) controlling the first electric motor driving the cutting device 52 so as to cut the unused part of the cable tie 12 at the end of the cycle, after the tie has been tightened around the bundle of cables 14.

In the operating mode without cutting, the device 10 is controlled according to the following steps:

a1) controlling the first electric motor driving the integrated fitting mechanism 30 so as to position the cable tie 12 in a closed loop around the bundle of cables 14, b1) controlling the second electric motor driving the tensioning device 38 so as to tighten the cable tie 12 around the bundle of cables 14 until the stopping of the electric motor corresponding to a complete tensioning of the tie on the bundle of cables 14, and c1) controlling the second electric motor in reversed rotation, relative to the direction of rotation used to tension the cable tie 12, at the end of the cycle, after the step b1) so as to eject the cable tie from the device 10 before the cutting has taken place.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]," or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A device, comprising: a fitting mechanism configured to form a cable tie into a closed loop around a bundle of cables by driving a free end of a cable tie around the bundle of cables and through a ratchet cage of the cable tie, the fitting mechanism comprising: a first electric motor; a drive shaft having a first cam and a second cam; and first and second opposing pivoting jaws; wherein the first electric motor configured to rotate the drive shaft such that the first cam actuates the first pivoting jaw, and the second cam actuates the second pivoting jaw in order to retain the bundle of cables between the first and second pivoting jaws; a tensioning device configured to tighten the cable tie around the bundle of cables, the tensioning device driven by a second electric motor; a cable tie strap cutter configured to cut an unused part of the cable tie after it has been tightened around the bundle of cables, the cable tie strap cutter driven by the first electric motor; an electronic unit that controls the first and second electric motors so as to control the fitting mechanism, the tensioning device, and the cable tie strap cutter; and a control interface configured to allow a user of the device to choose an operating mode of the device from a first operating mode and a second operating mode, the first operating mode comprising a first cycle during which the cable tie is tightened around the bundle of cables then, at the end of the first cycle, the unused part of the cable tie is cut so as to eliminate a free end section of the cable tie, and the second operating mode comprising a second cycle during which the cable tie is tightened around the bundle of cables then, at the end of the second cycle, the electronic unit is configured to reverse a direction of rotation of the second motor at the end of the second cycle so as to eject the cable tie from the device without cutting.

2. The device in accordance with claim 1, wherein the fitting mechanism further comprises:

a cable tie feeder configured to drive the free end of the cable tie through the first pivoting jaw, through the second pivoting jaw, around the bundle of cables, and through the ratchet cage of the cable tie.

3. The device in accordance with claim 1, further comprising:

a user interface configured to allow a user of the device to select the operating mode.

4. The device in accordance with claim 2, wherein the tensioning device further comprises:

a toothed wheel configured to engage a toothed portion of the cable tie and pull the free end of the cable tie through the ratchet cage.

5. The device in accordance with claim 4, wherein the toothed wheel further comprises:

a rotary encoder in communication with the electronic unit, the rotary encoder configured to count a number of teeth of the toothed wheel that engage the toothed portion of the cable tie.

6. The device in accordance with claim 5, wherein the electronic unit is further configured to determine a circumference of the cable tie remaining around the bundle of cables based on the rotary encoder.

7. The device in accordance with claim 4, wherein the drive shaft further includes a third cam configured to actuate the cable tie strap cutter to cut the free end of the cable tie at an outlet of the ratchet cage.

8. The device in accordance with claim 7, further comprising:

a user interface configured to allow a user of the device to select the operating mode, wherein the first electric motor is configured to further rotate the drive shaft to actuate the cable tie strap cutter when the first operating mode is selected from the user interface.

9. The device in accordance with claim 2, wherein the device further includes a removable cable tie magazine configured to dispense cable ties into the cable tie feeder.

10. A method, comprising: activating a fitting mechanism of a device, the fitting mechanism configured to fit a cable tie into a closed loop around a bundle of cables, the fitting mechanism includes a first electric motor, a drive shaft having a first cam and a second cam, first and second opposing pivoting jaws, and a cable tie feeder, wherein activating the fitting mechanism comprises: activating the first electric motor of the device; rotating, with the first electric motor, the drive shaft that includes the first cam, which actuates the first pivoting jaw of the device, and the second cam, which actuates the second pivoting jaw of the device, to retain the bundle of cables; and activating the cable tie feeder to attach the cable tie to the bundle of cables by looping a free end of the cable tie around the bundle of cables and through a ratchet cage of the cable tie; activating a tensioning device, driven by the rotation of a second electric motor of the device in a first direction, to tighten the cable tie around the bundle of cables thereby attaching the cable tie to the bundle of cables; and driving the rotation of the second electric motor of the device in a second direction to eject the cable tie from the device.

11. The method in accordance with claim 10, wherein the cable tie feeder is further configured to guide the free end of the cable tie around the bundle of cables and through the ratchet cage to fit the cable tie into the closed loop around the bundle of cables.

12. The method in accordance with claim 11, further comprises:

pulling, with a toothed wheel driven by the second electric motor, the toothed wheel configured to engage a toothed portion of the cable tie and drive the free end of the cable tie through the ratchet cage.

13. The method in accordance with claim 12, further including counting, with a rotary encoder included with the toothed wheel in communication with an electronic unit, a number of teeth of the toothed wheel that engage the toothed portion of the cable tie.

14. The method in accordance with claim 13, further including determining, with the electronic unit, a circumference of the cable tie remaining around the bundle of cables based on the rotary encoder.

15. The method in accordance with claim 12, further including cutting the free end of the cable tie at an outlet of the ratchet cage with a cable tie strap cutter actuated by a third cam included on the drive shaft.

16. The method in accordance with claim 11, further including dispensing, with a removable cable tie magazine, cable ties into the cable tie feeder.

* * * * *